US008129921B2

(12) United States Patent
Schleicher

(10) Patent No.: US 8,129,921 B2
(45) Date of Patent: Mar. 6, 2012

(54) SWITCHEGEAR, SYSTEM FOR CONTROLLING A LAMP, AND LIGHT CONTROL SYSTEM FOR A BUILDING COMPRISING AT LEAST ONE LIGHT

(75) Inventor: Gotthard Schleicher, Wonneberg (DE)

(73) Assignee: Osram AG, Munich (DE)

( * ) Notice: Subject to any disclaimer, the term of this patent is extended or adjusted under 35 U.S.C. 154(b) by 408 days.

(21) Appl. No.: 12/309,147

(22) PCT Filed: Jul. 13, 2007

(86) PCT No.: PCT/EP2007/057248

§ 371 (c)(1),
(2), (4) Date: Jan. 8, 2009

(87) PCT Pub. No.: WO2008/009637

PCT Pub. Date: Jan. 24, 2008

(65) Prior Publication Data

US 2009/0309512 A1 Dec. 17, 2009

(30) Foreign Application Priority Data

Jul. 20, 2006 (DE) ..... 10 2006 033 673

(51) Int. Cl.
*H05B 37/02* (2006.01)
*G05F 1/00* (2006.01)

(52) U.S. Cl. ..... 315/291; 315/307

(58) Field of Classification Search ..... 315/291, 315/307, 224, 209 R, 360, 362; 340/825.19, 340/825.27, 825.22, 5.1
See application file for complete search history.

(56) References Cited

U.S. PATENT DOCUMENTS 6,810,435 B2 * 10/2004 Palmer et al. ..... 710/8
(Continued)

*Primary Examiner* — Douglas W Owens
*Assistant Examiner* — Minh D A
(74) *Attorney, Agent, or Firm* — Holtz, Holtz, Goodman & Chick, PC

(57) ABSTRACT

The invention introduces the concept of priorities into DALI technology. A switchgear (18) used to this end comprises two inputs (28, 22) to which a DALI bus (40, 38) can respectively be connected, and an output (24) to which another DALI bus (26) can be connected. A data processing unit (56) allocates priorities to the signals entering via the two inputs (28, 22) according to pre-determined criteria, and supplies the signals to the output according to their priority, through which they are then forwarded to electronic ballasts (14). The switchgear (18), especially the data processing unit (56), decides which instruction is carried out by means of the priority assignment in the event of collision conflicts between different instructions, for example central building control instructions and local control instructions.

17 Claims, 1 Drawing Sheet

U.S. PATENT DOCUMENTS 7,417,556 B2 * 8/2008 Ling ..... 340/12.52
7,548,150 B2 * 6/2009 Huber et al. ..... 340/3.5
7,619,539 B2 * 11/2009 Veskovic et al. ..... 340/4.3
2003/0020595 A1 * 1/2003 Wacyk ..... 340/3.5
2005/0179404 A1 8/2005 Veskovic et al.
2006/0125426 A1 6/2006 Veskovic et al.

* cited by examiner

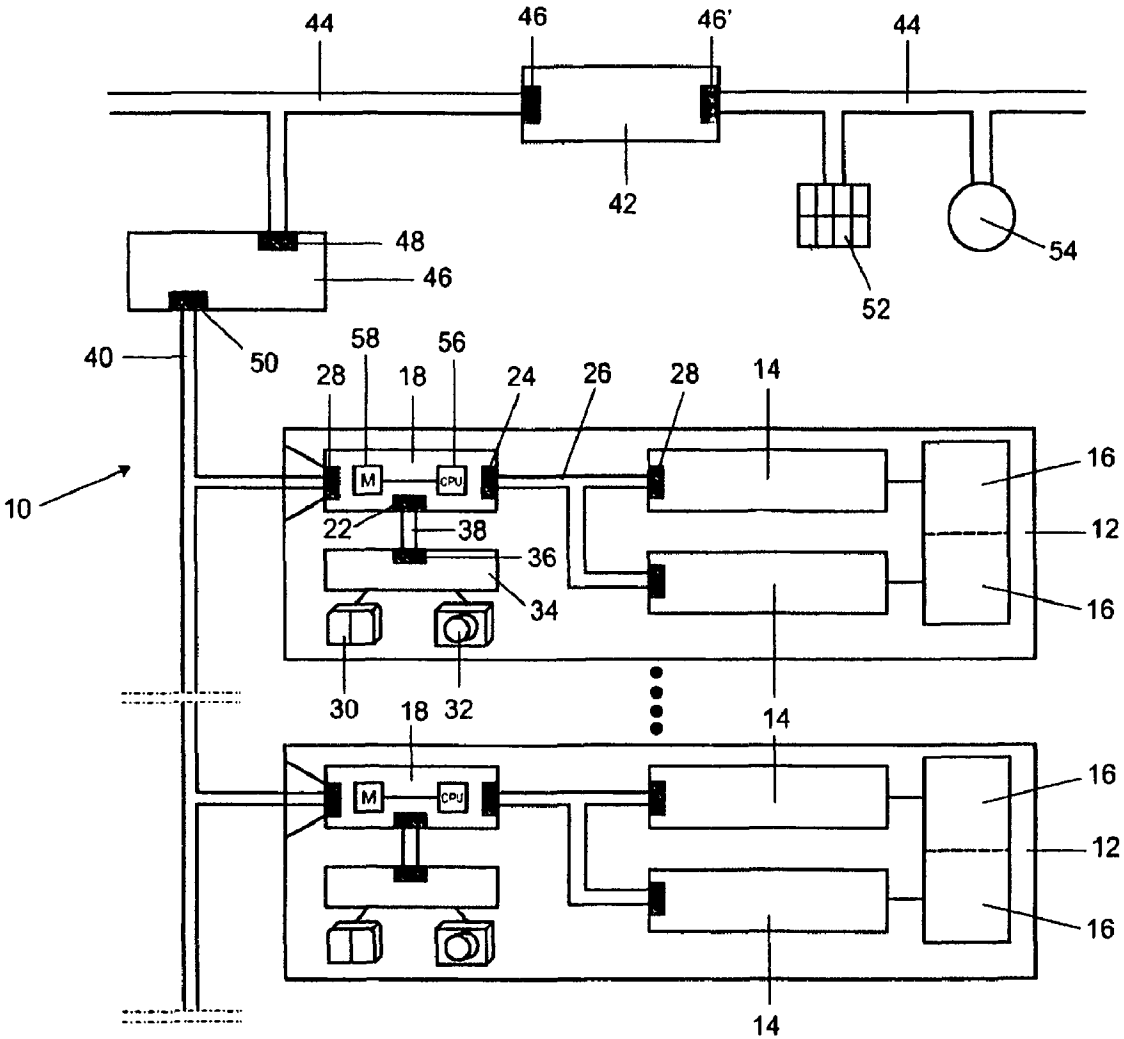
54
44
52
46'
42
46
44
48
46
50
40
10
16
12
16
14
28
26
24
56
18
58
28
CPU
M
22
38
36
34
32
30
16
12
16
14
18
CPU
M

SWITCHEGEAR, SYSTEM FOR CONTROLLING A LAMP, AND LIGHT CONTROL SYSTEM FOR A BUILDING COMPRISING AT LEAST ONE LIGHT

This application is a U.S. National Phase Application under 35 USC 371 of International Application PCT/EP2007/057248, filed Jul. 13, 2007, which is incorporated herein in its entirety by this reference.

TECHNICAL FIELD

The invention relates to a switching device, a combined switching/light control device, a system for controlling a lamp in which such a switching device is used and a light control system for a building comprising at least one light. The invention furthermore relates to a method for controlling a light. The invention belongs to the field of DALI technology, where DALI stands for "Digital Addressable Lighting Interface".

PRIOR ART

The DALI technology is a widely used technology which is used in controlling lights. It is used particularly successfully in building systems in which a multiplicity of lights are to be controlled. The use of the DALI technology can also be meaningful for controlling lights in individual rooms.

In building systems, central control of the lights is frequently in conflict with a local selection of lights. Particularly in the case of standing lamps, it is desirable that these can be switched on individually and can also be dimmed individually. It should also be possible to use a presence sensor which detects whether a person is located at a particular location (for example at a desk) and the standing lamp should be switched on or off or dimmed on the basis of this local information. On the other hand, it may be desirable that all lights are switched on and off centrally. After the end of working time, for example, it may be appropriate to switch off all lights when the light is not always switched off by the occupants of the building when they are leaving the building. It may also be appropriate to switch all lights on at the same time, for example at the times at which the cleaning service enters the building so that they do not have to manually switch all lights on and off again later.

In the prior art, the local control elements for controlling the lights (key switches and sensors) are all connected to a single bus of the building system. Accordingly, the control is very complicated and is associated with a high programming complexity. In the case of individual changes with respect to the presence of such local elements, the building control system must be reprogrammed elaboratory by programmers.

It is also disadvantageous that the DALI technology is a master/slave system. There is no collision conflict management. It is thus an unsolved problem that the DALI control system does not specify whether it is to follow local control instructions or control instructions related to the entire building when both are present simultaneously.

DESCRIPTION OF THE INVENTION

It is the object of the invention to provide means by means of which building control systems which use the DALI technology become more flexible in their control, for example allow both local and central switching of lights, ensuring at the same time that the building control system has a simple structure.

The object is achieved by a switching device according to patent claim 1, a combined switching/light control device according to patent claim 10, a system for controlling a lamp according to patent claim 11, a light control system for a building comprising at least one light according to patent claim 12 and a method for controlling a light according to patent claim 13.

The switching device according to the invention has two inputs to which a DALI bus can be connected in each case, and one output to which a DALI bus can be connected. Furthermore, it comprises a data processing unit which is designed for receiving signals arriving via the two inputs and for allocating priorities to the signals on the basis of predetermined criteria, the signals being supplied to the output in dependence on their priority.

By means of such a switching device, the concept of priorities is thus introduced for the DALI technology. Using priorities allows collisions conflicts to be resolved. Providing two inputs provides for the use of two DALI buses for controlling. A DALI bus will be selected in such a manner that local control is made possible and a second DALI bus will be selected in such a manner that central control is made possible. The local elements such as key switches and sensors can thus be connected to the first DALI bus and are independent of the second DALI bus, so that local control also does not need to take place via the central system but can be effected independently of the center, which as a result of the central control system is relieved. The system is thus structured more simply and more compactly.

The switching device preferably comprises a memory for temporarily storing signals. This makes it possible, on the one hand, initially to intercept signals received via the two inputs in order to be able to wait for what signals arrive overall. After a certain time, the situation may then occur that signals have arrived at the same time from both inputs so that the definition of a priority is particularly appropriate. In particular, the signal arriving later can then also receive the higher priority and thus be forwarded to the output before the signal which has arrived earlier in time.

The embodiment with the memory is also appropriate in conjunction with a further preferred embodiment according to which the switching device is designed for receiving return signals via the output which can be forwarded to one of the two inputs. This case occurs frequently if the signals supplied via the inputs contain certain enquiries. A typical case of such an inquiry is the inquiry as to whether a particular light is operable. It is advantageous if this embodiment with the receivable return signals is combined with that comprising the memory, because the return signals can then be stored until the two inputs, which then act as output, of course, are free. It is also possible that the switching device itself regularly delivers this type of inquiry, stores the response and, when an inquiry is received at the switching device, already has it ready and delivers its immediately.

In a preferred development of the embodiment with the memory, the data processing unit is designed for initiating the forwarding of the return signals to an input at a time which is specified in dependence on the priorities of signals previously received via the inputs. As a result, the time of forwarding the return signals can be selected in such a manner that there is no conflict in direction in the forwarding because the priorities are used for deciding whether data are first received at the inputs or data are sent out via the inputs. Using the priorities in forwarding the return signals is also meaningful because the history which has led to the generation of the return signal can then be taken into consideration. If, for example, this is an urgent inquiry, it is supplied via one of the two inputs and receives priority for being supplied to the output. Correspondingly, the return signals also arrive quickly and the return signals should then be sent back before a signal received via the second input is forwarded and causes possible reactions.

In a preferred embodiment, the switching device comprises a clock and the data processing allocates the priorities in dependence on clock time. This can occur in such a manner that the priorities are allocated exclusively in dependence on clock time, i.e. that the first one of the two inputs enjoys priority at determined clock times and the second of the two inputs enjoys priority at other clock times. In addition to the clock time, the priority can also be dependent on the type of signals.

The latter is appropriate, in particular, in conjunction with a preferred embodiment in which the data processing unit is designed for distinguishing between instruction types conveyed via the signals and allocating the priorities by means of the instruction types. This embodiment prevents a specification that the signals arriving via a certain input enjoy priority. Instead, a check is made as to whether these signals are actually of such a type that an assignment of a higher priority is justified. In conjunction with the clock-time-dependent specification of priorities, this embodiment can then be used, for example, in such a manner that, although, in principle, one of the two inputs enjoys priority as described above, determined instruction types enjoy an even higher priority so that the clock-time-dependent specification can be overcome by certain signals. This is appropriate, for example, if all lights are to be switched off at a certain time in a building and if a person located in that building then wishes to switch the light on again. Switching on again should then have priority over the basic instruction that all lights are switched off.

In a further preferred embodiment, the data processing unit is designed for allocating the priority in dependence on the order of the reception of individual signals. Thus, a signal received via a first input can be kept back, particularly with the aid of the abovementioned memory, and it can be waited to see whether a signal is also received via the second input. It is then possible either to give priority to the later signal or first to forward the signal received earlier and then to completely suppress the signal received later, that is to say not to supply it to the output at all or else at a distinctly later time.

In a further preferred embodiment, the data processing unit is designed for allocating the priorities for certain signals in dependence on whether and preferably which signals were received before the certain signals via the same input as these. This embodiment is appropriate, in particular, if a somewhat more elaborate sequence of control instructions is delivered. Thus, it would not be appropriate if such a sequence currently runs through via one of the two inputs, the system would then change following the forwarding of a signal from the second input because the latter would have a higher priority. This embodiment can be developed to the extent that a distinction is made not only between the instruction types which are contained in the signals but that a distinction is also made between sequences of instructions of determined instruction types. Thus, for example, a first signal sequence can have priority over a second signal sequence.

The system according to the invention for controlling a lamp exhibits: a switching device according to the invention, a local light control system with a light control unit which is connected to the first one of the two inputs of the switching device via a DALI bus, wherein sensors and/or operating elements for locally controlling the lamp are connected to the light control unit, and at least one electronic ballast to which the lamp is connected, the output of the switching device being connected to each electronic ballast via a DALI bus. This still leaves the second input of the switching device. This should be, at the same time, the input of the system for controlling a lamp so that the system as a whole can be connected to an external DALI bus.

Providing such a system for controlling a lamp allows, in particular, the compact and non-elaborate construction, already mentioned above in conjunction with the provision of the switching device, for a building control system. The system for controlling a lamp should represent a unit which is allocated to a lamp (or else several lamps simultaneously which jointly form at least one light). Such a system for controlling a lamp or several such systems can be arranged in each case in one room of the building. The system for controlling a lamp is thus the local module.

In a further preferred embodiment, the switching device is designed for generating a single output signal from two input signals arriving via different inputs. This functionality can become important, in particular, when it becomes difficult to allocate different priorities to the signals coming via the first input and the signals coming via the second input. An example of this is the reception of different signals via the two inputs within a very brief time. Thus, the switching device can detect with the aid of a clock, for example, when the individual signals arrive. A minimum period is specified for a nominal time interval for the signals. If the time drops below the minimum period, this means that the signals are interpreted as received virtually simultaneously and that as a compromise an output signal is then generated which satisfies in a certain respect the instructions conveyed in the two incoming input signals. An example of this would be if at a determined clock time, the instruction is given to switch the light off centrally at all lights and, at the same time, an operator switches on a certain light. As a compromise, said light can then be operated dimmed. As a result, the operator recognizes a change with respect to the previous state and knows that his operating action has had a consequence. At the same time, the basic trend of suppressing the illumination in the entire building is followed.

Since the switching device is arranged locally, the local module can also be expanded by a further functionality, namely by that of a light control device. This then provides a combined switching/light control device. This now only comprises one of the two inputs of the switching device and the output. Internally, the previous second input is connected to a light regulating unit. This internal connection does not need to utilize the DALI functionality. Instead of the second input, there is a possibility for connecting sensors and/or operating elements for locally controlling the lamp.

The local module, switching device or switching/light control device is preferably used in conjunction with a light control system for a building comprising at least one light as claimed in patent claim 12. The light control system comprises: a first bus according to a standard different from DALI (for example LON, Local Operating Network, or EIB, European Installation Bus). A gateway is connected to the bus via an interface to the first bus. The gateway has a DALI interface which is connected to a DALI bus. To the DALI bus, in turn, the system for controlling a lamp can be connected, namely with the aid of the abovementioned second input of the switching device. The light control system, finally, comprises a central control unit connected to the first bus. When the light control system is operated, this control unit sends control signals via the first bus, the gateway and finally the DALI bus to the switching device according to the invention which, of course, is located in the system for controlling a lamp.

The method according to the invention for controlling a light comprises the following individual steps: on the one hand, a light regulating unit sends first control signals via a first DALI bus to a switching device for locally controlling the light due to an operation of a local operating element (typically a switch) or signals of a local sensor (which, for example, measures the presence; heat sensor or camera). Independently of this, second control signals are sent to the switching device via a second DALI bus. The second control signals are also intended for controlling a light, this being a central control in this case, that is to say such a control which can affect several lights at the same time. The switching device then allocates in each case a priority to the first control signals and to the second control signals on the basis of predetermined criteria and (at least initially) only forwards the control signals having the higher priority in each case to at least one electronic ballast which, in turn, processes the control signals further and delivers output signals for the light. Because of the allocation of the priorities, the method according to the invention makes it possible that the first and second control signals can be generated (and finally sent to the switching device) independently of one another. Allocating the priority solves a possible collision conflict.

In a preferred embodiment of the method, the higher priority is allocated to the first control signals at first determined clock times and the higher priority is allocated to the second control signals at second determined clock times. This embodiment is particularly simple and takes into account the fact that controlling a light locally is appropriate if there are persons located in a respective building and that a central control, that is to say a control affecting several lights at the same time is appropriate when there are no persons in the building. But there are typical clock times for this purpose.

In a further preferred embodiment, the switching device distinguishes between different types of instructions which are conveyed with the control signals. The priority is allocated in dependence on the instruction types in the first and second control signals. This embodiment is very flexible because, in the case of a multiplicity of instructions, it is made possible that, on the one hand, the local control receives the priority and, on the other hand, central control receives the priority without this having to apply for all types of instructions, in principle.

In a further preferred embodiment of the method, the control device allocates the priority in dependence on signals received previously in time, in which arrangement, in particular, earlier priority allocations to the signals received previously can be taken into consideration. This preferred embodiment is appropriate especially when certain signal sequences are typically used. If, for example, a signal sequence has received a priority a first time, it should also retain this priority when it is continued.

BRIEF DESCRIPTION OF THE DRAWING(S)

In the text which follows, a preferred embodiment of the invention will be described with reference to the drawing, wherein the FIGURE diagrammatically illustrates a light control system for a building.

PREFERRED EMBODIMENT OF THE INVENTION

The FIGURE shows a light control system, designated by 10 as a whole, for a building. For each light in the building, a control system 12 is provided locally. The FIGURE shows two control systems 12. The dots between these control systems are intended to illustrate that a multiplicity of such systems can be provided. The control systems do not all need to be of the same type even if the two control systems 12 shown are presently shown to be of the same type. The systems 12 in each case comprise two electronic ballasts 14 which are in each case connected to the light. The light contains, for example, two lamps 16. Separating the two lamps 16 in each system 12 by dashes is intended to illustrate that jointly they form one light. The control system 12 also comprises a switching device 18. The switching device 18 has three DALI interfaces, wherein first and second interfaces 22 and 28 provide a DALI input and a third interface 24 provides a DALI output. At the output, that is to say at the DALI interface 24, a DALI bus 26 is connected, to which the electronic ballasts 14 are connected with DALI interfaces 28.

The system 12 also comprises elements arranged locally in the vicinity of the light, namely a key switch or light switch 30 and a sensor 32.

In principle, one of the two elements 30 or 32 is sufficient even if both are shown in the present case. The key switch 30 is intended to have the functionality of switching the lamp on and off as with any conventional light switch. The sensor 32 is intended to detect whether a person is located in the area irradiated by the lamp. The sensor 32 can be a camera. Heat and light sensors can also be used. The key switches 30 and 32 are connected to a light regulating unit 34 which selects the signals coming from the elements 30 and 32 and converts them into control signals for the electronic ballasts 14. The light regulating unit 34 has a DALI interface 36 and is connected via a DALI bus 38 to one input of the switching device 18, presently to the DALI interface 22. Control signals from the light regulating unit 34 can thus be conducted via the switching device 18 to the output 24. This provides the possibility of locally controlling the light.

To provide for central control at the same time, a further DALI bus 40 independent of the DALI bus 38 (naturally also of the DALI bus 26) is in each case provided at the other input of the switching device, that is to say the DALI interface 28. The DALI bus 40 is a multi-light bus which thus extends preferably over a building section. The central control of the lights is coordinated by a control device 42 which can also carry out other tasks connected with building control, for example connected with controlling the adjustments of blinds, heating etc. Since the tasks of the control device 42 are restricted not only to light controls, this bus 44, which differs from a DALI bus, is connected via an interface 46, 46'. The bus 44 can be, for example, an LON (Local Operating Network) bus or an EIB (European Installation Bus). A gateway 46 which has an interface 48 to the bus 44 and an interface 50 to the DALI bus 40 serves as connection between the buses 44 and 40. The gateway 46 thus converts signals passing to it via the bus 44 into signals which are sent via the DALI bus 40, and conversely. On the bus 44, other functionalities can be provided. For example, a key switch can also be provided here, namely the key switch 52 or a sensor 54. The key switch 52 and the sensor 54 are located, for example, at the building entrance. A person entering the building can thus switch on a light in the building by means of the key switch 52 already at the building entrance. As an alternative, it is possible to detect by means of the sensor 54 that a person is entering the building and selected lights can be activated, for example in the hallway. The control device 42 manages these central tasks and issues corresponding control instructions.

First control instructions are now arriving in the switching device 18 via the interface 28 and second control instructions are arriving via the interface 22. The central control instructions can be in conflict with the local control instructions. The switching device 18 has a data processing unit 56 (central processing unit CPU) which makes a decision as to which signal is forwarded when to the output interface 24. Criteria for this are stored in the data processing unit. The data processing unit is designed for identifying determined instruction types in the control signals. Determined instruction types receive priority, in principle, other determined instruction types receive priority over certain first other instruction types, but not predetermined second other instruction types, and some instruction types have no priority, in principle.

The data processing unit 56 can interact with a memory 58 ("M") and defer some-instruction types, for example for a determined time.

Clever programming of the data processing unit 56 thus allows conflicts possibly arising between control signals generated by the control device 42 and reaching the DALI interface 28 via the DALI bus, on the one hand, and control signals which are generated due to an actuation of the key switch 30 or an activation of the sensor 32 by the light regulating unit 34 to be resolved.

It is only the switching device 18, which enables central control (control device 42) and local control (light regulating unit 34) to compete. A multiplicity of scenarios are possible. Thus, a clock-time-dependent issuing of priorities is meaningful, for example, in office buildings which are left at particular clock times by the persons working there. During the working times, the local control (light regulating unit 34) can receive a fundamental priority, and outside of office times, the central control (control device 42) can receive priority. For further differentiation, it can also be provided that an instruction which initially has a higher priority, which is carried out at a particular time, is cancelled again at a later time. Thus, for example, it can be provided that all lights are switched off at 19:00 hours in the office building. If someone operates the key switch 30 at 19:05 hours, that is to say wishes to switch the light on again, the corresponding instruction is switched through and the corresponding light is activated again locally whilst all other lights remain switched off in the office building.

The structure of the switching device 18 does not prevent data from also being able to flow in the opposite direction. Thus, for example, the control device 42 can send an inquiry to the electronic ballast 14 at regular time intervals in order to detect whether one of the lamps 16 is defective. A corresponding response of the electronic ballast can be temporarily stored in the memory 58 and conducted at a quite particular time, for example when signals being received via the DALI interface 28 have priority, via the DALI interface 28 into the DALI bus 40 and via the gateway 46 to the control device 42.

Even if the switching device 18 and the light regulating unit 34 are presently shown as separate units, they can also be implemented in one unit. This then provides a combined switching/light regulating device which has only one input 28 and one output 24 towards the outside and to which the key switch 30 or the sensor 32 can be connected. The internal connection does not need the DALI bus 38.

The invention provides for the first time a light control system for a building in which a local control and a central control supplement one another in a flexible manner. For this purpose, a system 12 for controlling a lamp (with or without lamp 16) is provided locally in each case and the interface 28 of the switching device 18 is then at the same time input to the entire system 12. The remaining bus structure implemented in the building with the buses 44, the gateway 46 and the DALI bus 40 is very simple. Whilst in the prior art the local elements, for example of the type of the key switch 30 or of the sensor 32, were directly connected to the building bus (which corresponds to the bus 40), the local control is now carried out completely independently of the central control device 42, namely with the aid of the light regulating unit 34.

The invention claimed is:

1. A switching device (18) comprising a first input (28) to which a first independent DALI bus (38) can be connected, and a second input (22) to which a second independent DALI bus (40) can be connected, and comprising one output (24) to which a third independent DALI bus (26) can be connected, and with a data processing unit (46) which is designed for receiving signals arriving via the first and the second inputs (28, 22) and for allocating priorities to the signals on the basis of predetermined criteria, the signals being supplied to the output (24) in dependence on their priority.

2. The switching device as claimed in claim 1, comprising a memory (58) for temporarily storing signals.

3. The switching device as claimed in claim 1 or 2, characterized in that it is designed for receiving return signals via the output (24) which can be forwarded at least to the first or the second input (28, 22).

4. The switching device as claimed in claim 3, characterized in that the data processing unit (56) is designed for initiating the forwarding of the return signals to an input (28, 22) at a time which is specified in dependence on the priorities of signals previously received via the inputs.

5. The switching device as claimed in claim 1, characterized in that it comprises a clock and in that the data processing unit (56) allocates the priorities in dependence on clock time.

6. The switching device as claimed in claim 1, characterized in that the data processing unit (56) is designed for distinguishing between instruction types conveyed via the signals and allocating the priorities by means of the instruction types.

7. The switching device as claimed in claim 1, characterized in that the data processing unit (56) is designed for allocating the priorities in dependence on the order of the reception of individual signals.

8. The switching device as claimed in claim 1, characterized in that the data processing unit (56) is designed for allocating the priorities for certain signals on dependence on whether and preferably which signals were received before the certain signals via the same input as these.

9. The switching device as claimed in claim 1, characterized in that it is designed for generating a single output signal from two input signals being received via different independent inputs.

10. A light control system (10) for a building comprising at least one light, comprising:

at least one system (12) for controlling a lamp as claimed in claim 9, a first bus (44) according to a standard different from DALI, a gateway (46) with an interface (48) to the first bus (44) and a DALI interface (50), a DALI bus (40), a central control unit (42), connected to the first bus (44), which sends control signals via the first bus (44), the gateway (46) and the DALI bus (40) to the switching device (18) of the system (12) for controlling a lamp.

11. A switching/light control device comprising a switching device as claimed in claim 1, and comprising a light regulating unit which is connected internally to the first one of the two inputs of the switching device, wherein the switching/light control device has, additionally to the first input and the output of the switching device, a connecting capability for a sensor and/or an operating element for locally controlling the lamp.

12. A system (12) for controlling a lamp (16), comprising:

a switching device (18) as claimed in claim 1, a local light regulating system with a light regulating unit (34) which is connected to the first one of the two inputs (22) of the switching device (18) via a DALI bus (38), wherein sensors (32) and/or operating elements (30) are connected to the light regulating unit (34) for locally controlling the lamp (16), at least one electronic ballast (14) to which the lamp (16) is connected, wherein the output (24) of the switching device (18) is connected to each electronic ballast (14) via a DALI bus (26), wherein the second input (28) of the two inputs (28, 22) of the switching device (18) is at the same time input of the system (12) for controlling a lamp so that the system (12) can be connected to an external DALI bus (40) for controlling a lamp.

13. A method for controlling a light, in which for locally controlling the light, a light regulating unit (34), on the basis of an operation of a local operating element (30) or of signals of a local sensor (32), sends first control signals via a first bus (38), to a switching device (18), for the control simultaneously affecting several lights, second control signals are sent via a second bus (40) which is constructed as a DALI bus, to the switching device (18), wherein the switching device in each case allocates a priority to the first control signals and to the second control signals on the basis of predetermined criteria and at least initially only forwards the control signals having the in each case higher priority to at least one electronic ballast (14) which processes the control signals further and delivers output signals to the light (16).

14. The method as claimed in claim 13, characterized in that the higher priority is allocated to the first control signals at first determined clock times and the higher priority is allocated to the second control signals at second determined clock times.

15. The method as claimed in claim 14, characterized in that the switching device allocates the priority in dependence on signals received previously in time and preferably on priority allocations to the received signals.

16. The method as claimed in claim 13, characterized in that the switching device (18) distinguishes between different types of instructions which are conveyed with the control signals and allocates the priority in dependence on the instruction types in the first and second control signals.

17. The method claimed in claim 13, wherein the first bus (38) is a DALI bus.

* * * * *